US007077291B1

(12) United States Patent
Bell et al.

(10) Patent No.: US 7,077,291 B1
(45) Date of Patent: Jul. 18, 2006

(54) PACKAGE ASSEMBLY WITH FOAMED TOPPING

(75) Inventors: Scott A. Bell, Redondo Beach, CA (US); James E. Hawes, Palm Springs, CA (US)

(73) Assignees: Scott Bell, Redonda Beach, CA (US); James Hawes, Redonda Beach, CA (US)

( * ) Notice: Subject to any disclaimer, the term of this patent is extended or adjusted under 35 U.S.C. 154(b) by 43 days.

(21) Appl. No.: 10/407,786

(22) Filed: Apr. 7, 2003

(51) Int. Cl.
*B65D 47/04* (2006.01)

(52) U.S. Cl. ..... 222/83; 222/80; 222/541.2; 222/541.5; 206/222; 215/6; 215/112; 426/112; 426/115; 426/123; 220/521

(58) Field of Classification Search ..... 222/80, 222/81, 83, 83.5, 541.1–541.9, 88, 91; 141/363–366, 141/375; 206/219, 222; 215/6, DIG. 8; 426/112, 115, 118, 123
See application file for complete search history.

(56) References Cited

U.S. PATENT DOCUMENTS

| | | | | |
|---|---|---|---|---|
| 4,221,291 | A * | 9/1980 | Hunt | 206/222 |
| 4,832,968 | A * | 5/1989 | Forage et al. | 426/112 |
| 5,290,574 | A * | 3/1994 | Jamieson et al. | 426/112 |
| 5,381,914 | A * | 1/1995 | Koyama et al. | 215/341 |
| 5,980,959 | A * | 11/1999 | Frutin | 426/112 |
| 2001/0035427 | A1 * | 11/2001 | Mawby et al. | 222/78 |

* cited by examiner

*Primary Examiner*—J. Casimer Jacyna

(57) ABSTRACT

The present invention provides a package assembly that incorporates a foamable topping under pressure and provides the consumer with a fresh, foamed topping when the package is opened. In one version, the topping material is carried under pressure on top of the liquid contents of the package, and foams when the package is opened. In other versions the topping is carried within the cap or cover of the package, and is selectively dispensed by the consumer after the package has been opened.

9 Claims, 2 Drawing Sheets

PACKAGE ASSEMBLY WITH FOAMED TOPPING

INTRODUCTION

The present invention relates to a package assembly for a foamed topping, preferably one that is designed to function as a bottle cap or cover for a container that has within it contents suitable to form a foamed topping, such as whipped cream.

Convenience products are quite popular. Many such products are enhanced by a fresh foamed or whipped topping. Yet at present there is no container designed to incorporate a topping that the user can dispense onto the contents, thereby to provide a fresh foamed topping. For example, various bottled Starbucks' coffee products are now offered in convenience stores. When purchased at a Starbucks, these products can be finished with a foamed topping, such as foamed milk or whipped cream, and many consumers prefer them with such a topping. But the bottled products only are provided without a foamed topping, mainly because there is no satisfactory container currently in use that permits the purchaser to dispense a fresh foamed topping onto the container's contents just prior to their consumption.

An object of the present invention is to provide a package assembly incorporating a foamable topping, the package serving as a bottle cap or cover, for example, and that allows the user to dispense a foamed topping onto the contents of the package prior to the consumption of those contents. Another object is to provide a simple, effective and inexpensive package or container for a foamable topping. These and other objects of the invention will be apparent to those of ordinary skill in this field from the following description of preferred embodiments of the invention.

BRIEF SUMMARY OF THE INVENTION

The present invention provides a package assembly that includes a container and a product within the container that is enhanced with a fresh, foamed topping. In various embodiments a foamable liquid is held under pressure within the container. By opening the container a fresh foamed topping may be dispensed onto the product. In one embodiment the liquid is simply a layer on top of the product. In another version the liquid is held within a chamber provided in a cap closing the package. Any of various alternate structures may be employed to selectively dispense the foamable liquid from the chamber.

BRIEF DESCRIPTION OF THE DRAWINGS

The invention will be further described in connection with the accompanying drawings in which.

DETAILED DESCRIPTION

Foamed toppings are used on a variety of consumable products. For example, Starbucks at its stores offers various coffee drinks with a foamed topping if desired by the consumer, and many prefer such a foamed topping. Bars often serve various alcoholic drinks with a foamed topping—a Brandy Alexander is often served with a whipped cream topping. Various ice cream selections are offered topped with whipped cream at an ice cream parlor. Yet while all these products can be purchased prepackaged, none of the prepackaged versions offer the consumer the option of a fresh foamed or whipped topping. Should a consumer prefer such a topping, it must be obtained elsewhere; the package containing the latte or other product does not provide the option of a fresh foamed topping.

A package that includes a fresh foamed topping can be provided in various ways. Because of this, the present invention in its broadest aspects simply provides such a package, the following embodiments being exemplary of such a package.

Figure 1:
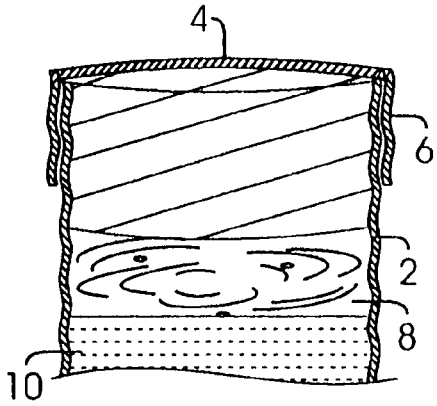
FIG. 1 is an elevational view in cross-section of the top of a bottle with a foamable liquid therein.
Figure 2:
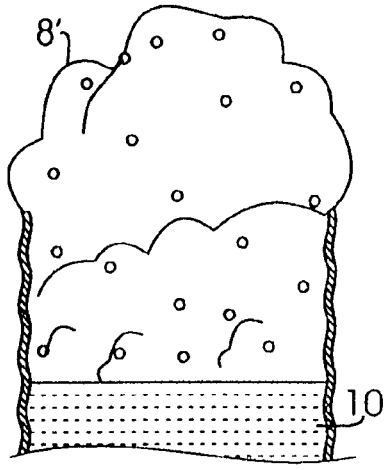
FIG. 2 is an elevational view in cross-section similar to FIG. 1 but now opened and showing the fresh, foamed topping.

One such package is shown in FIG. 1. In this version, it consists of a bottle 2, the neck of which is shown, A cap 4 has a threaded collar 6 that may be screwed down on cooperating threads provided on the bottle, thereby to close the bottle in a conventional way. A relatively thick liquid layer 8 is deposited in the bottle on top of a beverage 10. Layer 8 includes within it a dissolved gas, such as nitrogen or carbon dioxide. This charging gas is retained within the layer by virtue of the bottle's contents being pressurized, either because the beverage includes a charging gas or because part of the gas in layer 8 escapes after the cap is screwed down to seal the bottle. Or as the bottle may be closed in a pressurized environment, the space over layer 8 and beneath cap 4 thereby including a pressurizing gas. Once pressurized, the gas above layer 8 helps to hold the gas in layer 8 in solution. During handling and transportation, of course the bottle may be jostled, tilted or inverted. The density of layer 8 should be less than the density of beverage 10 so that the layer will rise to the top of the bottle when it is placed on display for sale. This can be achieved by adjusting the amount of gas within layer 8 to make it more buoyant that the beverage. On opening the bottle by removing the cap 4, the pressurized gas dissolved in layer 8 causes the layer to foam and provide a foamed topping for the bottle's contents. This is shown in FIG. 2, layer 8 now being the foamed topping 8'.

Such a unitary package is suitable for certain applications. The pressurized gas in layer 8 must not diffuse to any significant degree into contents 10 while cap 4 closes the bottle. This requires a balancing of the nature of the contents and the nature of layer 8. When layer 8 consists mainly of a thick cream or other similarly viscous material, it usually will hold a fair charge of foaming gas for a reasonable period of time, even when the contents 10 of the bottle are a thin liquid such as a mainly water-based material. When the contents 10 of the bottle are charged with a gas, such as occurs for a carbonated beverage, then it is much simpler to hold the pressurizing gas in solution in layer 8, especially when the gas pressures in the bottle 2, layer 8 and contents 10 are about the same.

Figure 3:
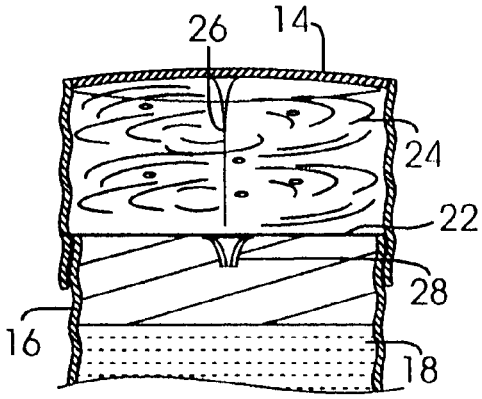
FIG. 3 is an elevational view in cross-section of the top of a bottle with a cap thereon incorporating another version of the invention.

Another version of the invention is shown in FIG. 3. In it, a cap assembly 14 is screwed down on, and closes, bottle 16 containing a beverage 18. The cap assembly has a thin membrane 22 stretched across and closing the top portion of the cap to form a closed chamber. Within this closed chamber is a foamable topping liquid 24, consisting of a topping liquid and a dissolved charging gas. A shaft or pin 26, or equivalent perforation means, is fixed to the inner surface of the cap, and extends through the charging liquid to almost reach membrane 22. Preferably a nozzle 28 is fixed to the membrane in alignment with the shaft or pin.

After cap 14 has been unscrewed from the bottle, and when the consumer desires to have a foamed topping on the contents of the bottle, by depressing the top center of the cap, pin 26 may be caused to perforate membrane 22 thereby releasing liquid 24 to pass through nozzle 28 and be directed onto the contents of the bottle. As liquid 24 passes from a pressurized region or chamber within the cap to an area of lower pressure, namely atmospheric pressure, the gas dissolved in liquid 24 will cause the liquid to foam in a manner well known to those of ordinary skill in this field. This design of package or container does not permit the dispensed amount of foamed liquid to be controlled by the user. Once membrane 22 is perforated substantially the entire contents held within the chamber of the cap is dispensed.

Figure 4:
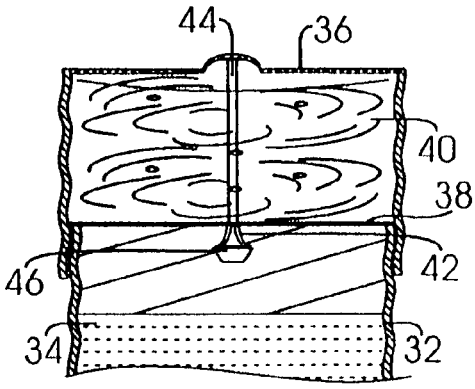
FIG. 4 is an elevational view in cross-section of the top of a bottle with a cap thereon incorporating still another version of the invention.

In some applications it may be desirable to allow the consumer to selectively control the dispensed amount of foamed liquid. A variation of the invention that permits this is shown in FIG. 4. It consists of a bottle 32 containing a beverage 34 and with a top opening closed by a cap assembly 36. A membrane 38 closes the top portion of the cap to form a closed chamber. Within this closed chamber is a foamable liquid 40 much like liquid 24. Because liquid 40 is at a pressure greater than atmospheric pressure, and because cap 36 is relatively thin, the top of the cap will be convex or tend to bow out. This firmly holds the conical base 42 of a shaft 44 against a mating conical nozzle 46 fixed to the center of the membrane 38. After the cap is removed from the bottle, and when the consumer desires to dispense a foamed topping onto the bottle's contents, this may be achieved by pressing the top center of the cap to cause the shaft to move the conical base away from the mating side of nozzle 46, thereby to permit liquid 40 to pass through the nozzle and provide a foamed topping. When the desired amount of topping has been dispensed, the consumer simply releases pressure on the top center of the cap to permit shaft 44 to retract base 42 against nozzle 46 and close the top portion of the cap. Of course, if later more topping is desired, all the consumer need do is again depress the center of the cap to dispense more topping from nozzle 46.

Figure 5:
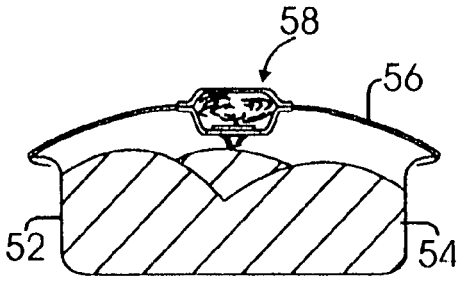
FIG. 5 is an elevational view in cross-section of a dish assembly incorporating a further version of the invention.
Figure 6:
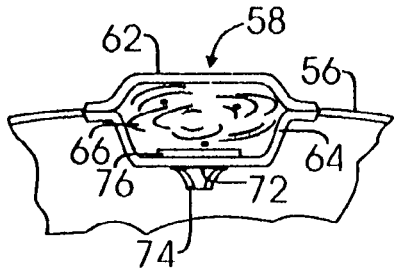
FIG. 6 is an elevational view in cross-section of a portion of the lid of the dish shown in FIG. 5.

The embodiments of the invention which have been described all assume a bottle with a liquid therein. There are many products, however, that are not a liquid but that are enhanced by a fresh foamed topping. For example, one or more scoops of ice cream in a dish often is finished with a whipped cream or other foamed topping, such as Cool Whip. A package of this sort is shown in FIG. 5, in which a plastic dish 52 includes multiple scoops of ice cream 54 and a cover 56. This cover includes a foamed topping dispenser 58 shown enlarged in FIG. 6. The dispenser preferably consists of a raised central portion 62 of cover 56. Beneath this raised portion is a cup assembly 64 defining, with portion 62, a chamber for a foamable topping liquid 66.

At the center of the cup 64 is an opening 72 beneath which is a nozzle 74. A flap 76 is attached to the interior of the cup assembly and has a free portion that extends across and closes opening 72. By deforming or distorting cover 56 and the attached cup 64, the base of the cup may be wrinkled slightly to allow the pressurized liquid 66 to flow between the flap and the wrinkled cup base, then out nozzle 74 and onto ice cream 54 to provide a fresh foamed topping.

Figure 7:
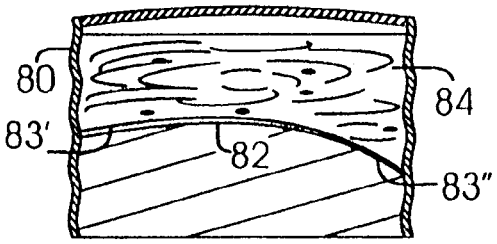
FIG. 7 is an elevational view in cross-section of another cap assembly.
Figure 8:
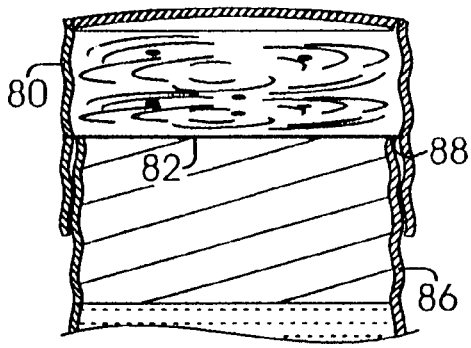
FIG. 8 is an elevational view in cross-section of the cap assembly of FIG. 7 on the top of a bottle.

Certain applications are suitable for a foamable topping carried in a cap, the topping being automatically dispensed onto the beverage in the container when the cap is unscrewed. Such a construction is shown in FIGS. 7 and 8. In it, a cap 80 is formed to include an arched membrane 82, one edge sector 83' being closer to the top of the cap than another sector 83", the membrane defining a closed space or chamber for a foamable topping material 84. When this cap is screwed down about the top portion of a bottle 86, the rim 88 of the bottle will engage first the edge sector 83" of the membrane 82 and shear only this portion of the edge free from the cap. However, until the bottle is opened the pressure within the enclosed space of the cap will hold the freed edge against the rim of the bottle. When the cap is unscrewed, the foamable contents 84 now may flow between the cap and the sheared edge of the membrane, and into the bottle to provide its contents with a fresh foamed topping.

Many of the foregoing embodiments of the invention are shown with a bottle having a threaded neck portion, the cap assembly also having threads that mate with those on the bottle to hold the cap to the bottle. Of course, there are many other ways to attach the cap to a bottle or other container. A common way is to provide a protruding rim about the top edge of the container, and a cooperating intruding rim on the edge of the cap, the protruding and intruding rims interlocking with one another when the cap closes the container and holding the cap tightly to the container. The foregoing embodiments shown with cooperating threads could have employed instead cooperating rims to hold the cap to the container if the user so preferred, each being an example of a means to hold the cap to the container.

In such fashions as these a package assembly may be provided that allows the consumer to enjoy a product with a fresh foamed topping. Of course, given the teachings herein set forth many variations of such a package assembly will be apparent to those of ordinary skill in this field. Accordingly, the scope of the invention is not defined by the specific embodiments of the package assemblies that have been shown and described, but rather is as set forth in the following claims.

What is claimed is:

1. A package assembly including a bottle having an opening, a product within the bottle, the product being one which many consumers prefer to enjoy with a fresh, foamed topping, a cap assembly, means attaching the cap assembly to the bottle to close the bottle's opening, the cap assembly including a cap, a membrane extending across the interior of the cap and enclosing a chamber between the cap and the membrane, a foamable liquid held under pressure within the chamber of the cap assembly, and means to enable the consumer to selectively dispense some or all of the foamable liquid from the chamber, thereby to provide a desired amount of the fresh foamed topping for the product within the bottle.

2. A package assembly as set forth in claim 1 in which the cap assembly further includes a nozzle, the means to selectively dispense the foamable liquid dispensing the liquid through the nozzle.

3. A package assembly as set forth in claim 2 in which the means to selectively dispense the foamable liquid from the cap includes a shaft, the shaft being aligned with the nozzle and selectively movable relative to the membrane.

4. A package assembly as set forth in claim 3 in which the shaft includes an end portion received within the nozzle and closing the nozzle, the shaft being movable relative to the nozzle to open the nozzle and dispense only as much of the foamed topping as is desired at that time.

5. A cap assembly for selectively closing a container having a product that many prefer to enjoy with a fresh, foamed topping, the cap assembly including a cap, a membrane extending across the interior of the cap and enclosing a chamber between the cap and the membrane for receiving a foamable liquid, and means to selectively dispense some or all of the foamable liquid from the chamber.

6. A cap assembly as set forth in claim 5 in which the cap assembly further includes a nozzle, the means to selectively dispense the foamable liquid dispensing the liquid through the nozzle, and means for selectively holding the cap assembly to a container to close the container.

7. A cap assembly as set forth in claim 6 further including a foamable liquid within the chamber.

8. A cap assembly as set forth in claim 6 in which the means to selectively dispense the foamable liquid from the cap includes a shaft, the shaft being aligned with the nozzle and selectively movable relative to the membrane.

9. A cap assembly for removably closing an opening in a container for contents normally used with a foamed topping, the cap assembly including a cap having a rim and a depressed center to form a cup, means for selectively holding the cap assembly about an opening in a container to close the container, a membrane extending across the interior of the cap and enclosing a chamber between the cap and the membrane for receiving a foamable liquid, a nozzle attached to the membrane, a foamable liquid within the chamber, and means to selectively dispense the foamable liquid from the chamber through the nozzle to provide a foamed topping, the means to selectively dispense the foamable liquid including a shaft, the shaft being aligned with the nozzle and selectively movable relative to the membrane.

* * * * *